US006443790B1

(12) United States Patent
Cameron

(10) Patent No.: US 6,443,790 B1
(45) Date of Patent: Sep. 3, 2002

(54) APPARATUS AND METHOD FOR FORMING BUBBLES FOR AMUSEMENT

(76) Inventor: Rodney L. Cameron, 124 Fillmore Ave., Oxnard, CA (US) 93035

( * ) Notice: Subject to any disclaimer, the term of this patent is extended or adjusted under 35 U.S.C. 154(b) by 0 days.

(21) Appl. No.: 09/465,117

(22) Filed: Dec. 16, 1999

Related U.S. Application Data

(60) Provisional application No. 60/112,612, filed on Dec. 16, 1998.

(51) Int. Cl.[7] ..... A63H 33/28

(52) U.S. Cl. ..... 446/15; 446/20; 446/19

(58) Field of Search ..... 446/15–21; 401/195, 401/52, 196, 200

(56) References Cited

U.S. PATENT DOCUMENTS

| | | | | | |
|---|---|---|---|---|---|
| 1,284,440 | A | * | 11/1918 | Pierce | 446/19 |
| 1,526,052 | A | * | 2/1925 | Christian | 446/20 |
| 2,720,723 | A | * | 10/1955 | Peretti | 446/15 |
| 2,976,560 | A | * | 3/1961 | Turner | 401/205 |
| 3,561,154 | A | * | 2/1971 | Skinner | 446/19 |
| 3,579,898 | A | * | 5/1971 | Hein | 446/16 |
| 3,949,137 | A | * | 4/1976 | Akrongold et al. | 15/104.93 |
| 4,077,725 | A | * | 3/1978 | Slautterback | 401/195 |
| 4,411,095 | A | * | 10/1983 | Rushing et al. | 446/20 |
| 4,613,446 | A | * | 9/1986 | Magyar | 15/104.93 |
| 4,747,720 | A | * | 5/1988 | Bellchumeur et al. | 401/196 |
| 4,886,388 | A | * | 12/1989 | Gulker et al. | 401/196 |
| 4,932,096 | A | * | 6/1990 | Chown | 15/244.3 |
| 4,976,645 | A | * | 12/1990 | Wesson et al. | 446/15 |
| 5,010,615 | A | * | 4/1991 | Carter | 15/104.94 |
| 5,695,379 | A | * | 12/1997 | Ho | 446/15 |
| 6,171,004 | B1 | * | 1/2001 | Derhammer | 401/196 |

FOREIGN PATENT DOCUMENTS

| | | | | | |
|---|---|---|---|---|---|
| GB | 1379287 | A | * | 1/1975 | A63H/33/28 |
| NL | 9201538 | A | * | 1/1994 | A63H/33/28 |

* cited by examiner

*Primary Examiner*—Derris H. Banks
*Assistant Examiner*—Urszula M. Cegielnik
(74) *Attorney, Agent, or Firm*—Kelly Bauersfeld Lowry & Kelley, LLP

(57) ABSTRACT

A bubble forming apparatus includes a member which defines a bubble forming aperture, and a reservoir of liquid soap concentrate in fluid communication with the bubble forming member. A duct extends from the reservoir to one or more outlets disposed adjacent to the bubble forming aperture such that the liquid soap concentrate can flow from the reservoir to the bubble forming member. A channel may be formed within the bubble forming member adjacent to the bubble forming aperture to facilitate the flow of liquid soap concentrate to the bubble forming aperture. An open-cell wick which extends from the reservoir to the bubble forming member may also be used to deliver the liquid soap concentrate to the bubble forming member. A liquid permeable lining may be disposed between the outlets and the bubble forming aperture. The reservoir includes a fill port for refilling the reservoir with liquid soap concentrate when necessary. In one embodiment, a handle of the apparatus defines the reservoir. In another embodiment, the handle is telescopically collapsible and expandable.

11 Claims, 3 Drawing Sheets

APPARATUS AND METHOD FOR FORMING BUBBLES FOR AMUSEMENT

RELATED APPLICATION

This application claims priority from provisional application Ser. No. 60/112,612 filed Dec. 16, 1998.

BACKGROUND OF THE INVENTION

The present invention relates to bubble forming devices. More particularly, the present invention relates to a bubble forming device which uses water as a catalyst to form bubbles out of liquid soap concentrate, such as common liquid soap.

Devices which produce bubbles have been known for quite some time. There are a number of devices in the form of wands and the like which create bubbles, many of which are hand-held and dipped into a reservoir of bubble forming solution and then blown across to form the bubbles. The majority of these devices are rigid is shape and size and take up storage space.

These prior devices also suffer other drawbacks. With many of these devices one not only has to concern himself or herself with providing the device, but often times needs a container of bubble forming solution specifically formulated to form bubbles. In certain instances, the user may even need a provide a separate receptacle which holds the bubble forming solution in order to dip the device.

Because these devices are necessarily dipped into an open reservoir, and also due to the fact that children often are the users of these devices, the contents of the reservoir often times spill. Not only creating a mess on both the child and surrounding area, this also wastes bubble forming solution and limits the amount of bubbles that can be produced. Similarly, stocking bottles of bubble solution is a concern in the retail environment as the bottles occupy valuable shelf space and may spill.

Due to the fact that the bubble forming solution used by these devices is specific in nature, the user must separately purchase the bubble forming solution and store the bubble forming solution between play sessions. In the event that the bubble forming solution is spilled or otherwise exhausted, the child's parent must be inconvenienced by traveling to the store and purchasing more bubble forming solution before the child can resume bubble blowing.

Accordingly, there is a need for an apparatus which alleviates the requirements of having not only a bubble forming device, but also a container of bubble forming solution specific to the device. What is also needed is a device which is compact and easy to transport and store. Such a device should be able to use common household liquid soap in order to avoid the purchase and storage of bubble forming solution. The present invention fulfills these needs and provides other related advantages.

SUMMARY OF THE INVENTION

The present invention resides in a bubble forming apparatus which utilizes common liquid soap concentrate, such as liquid dishwashing soap, contained within a reservoir of the apparatus. A water-based liquid is used as a catalyst to form bubbles. The apparatus eliminates the need for branded bubble forming solutions.

In one embodiment, the apparatus includes a bubble forming member which defines a bubble forming aperture. A hollow handle defines a reservoir of liquid soap concentrate. The handle may be comprised of a pre-filled liquid soap concentrate reservoir which is removably attachable to the bubble forming member. The reservoir is in fluid communication with the bubble forming member via a duct extending from the reservoir to one or more outlets disposed adjacent to the bubble forming aperture such that the liquid soap concentrate can flow from the reservoir to the bubble forming member. A channel may be formed within the bubble forming member adjacent to the bubble forming aperture to facilitate the flow of liquid soap concentrate. The reservoir includes a fill port for refilling the reservoir with liquid soap concentrate when necessary.

In another embodiment, an open-cell wick extends from the reservoir and through the duct and to the bubble forming member. The wick may be disposed within the channel of the bubble forming member. As the wick is immersed into the soap in the reservoir, the soap is absorbed into the wick and travels up and through the wick until the soap reaches the bubble forming member aperture, saturating the wick completely.

In yet another embodiment, the handle is telescopically collapsible and expandable. The reservoir encircles an outer edge of the bubble forming member of the apparatus. The reservoir also has a fill port which is able to be opened to receive liquid soap concentrate. The reservoir is in fluid communication with multiple outlets disposed adjacent to the bubble forming aperture via at least one duct extending between the reservoir and the outlets. A liquid permeable lining may be disposed between the outlets and the bubble forming aperture.

Bubbles are formed by filling the reservoir with liquid soap concentrate, or using the pre-filled reservoir handle, and delivering the liquid soap concentrate to the aperture of the bubble forming member. Depending on the embodiment used, delivery entails squeezing a flexible housing which defines the reservoir to force the liquid soap concentrate to the bubble forming member, allowing the liquid soap concentrate to gravitationally flow form the reservoir to the bubble forming member, or saturating the open-cell wick with the liquid soap concentrate. The bubble forming member is then wetted by dipping it in an external water-based liquid to create a bubble film over the bubble forming member. An airstream is introduced across the bubble film by either waving the apparatus or blowing across the bubble forming member to produce bubbles.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 3:
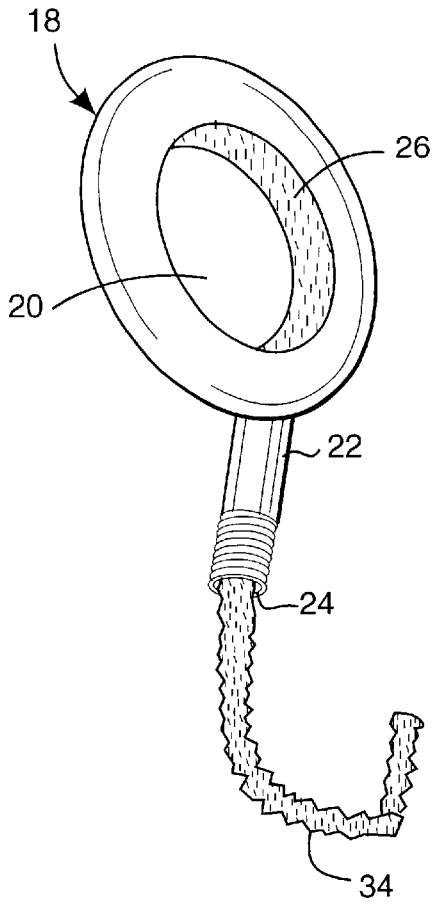
FIG. 3 is a perspective view of an alternative bubble forming member similar to that shown in FIG. 2, having a wick extending therefrom.
Figure 4:
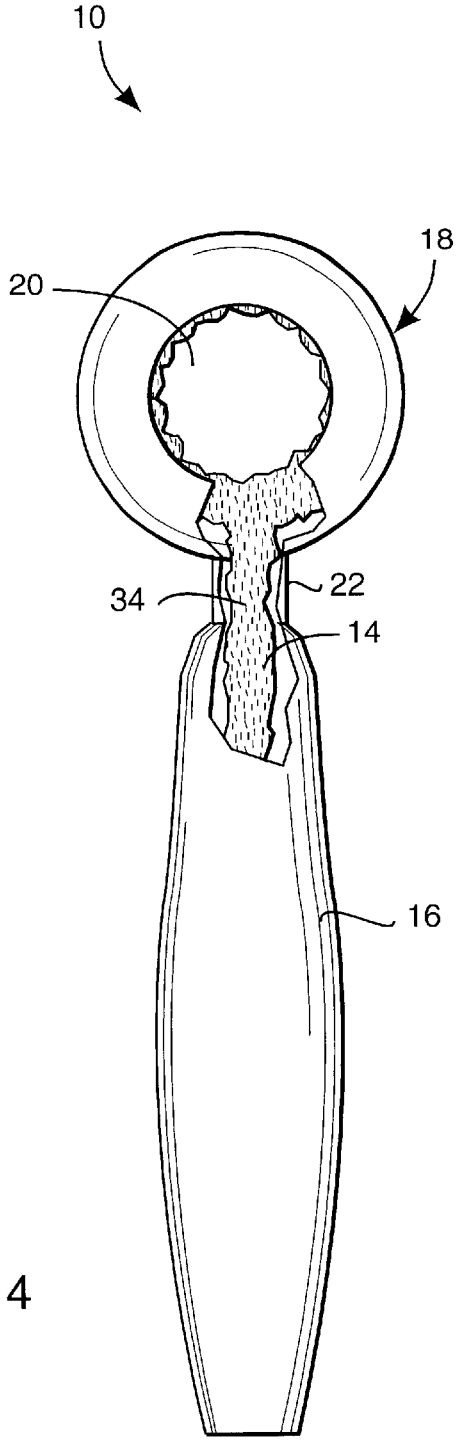
FIG. 4 is a partially fragmented elevational view of a bubble forming apparatus incorporating the wicked bubble forming member of FIG. 3.
Figure 5:
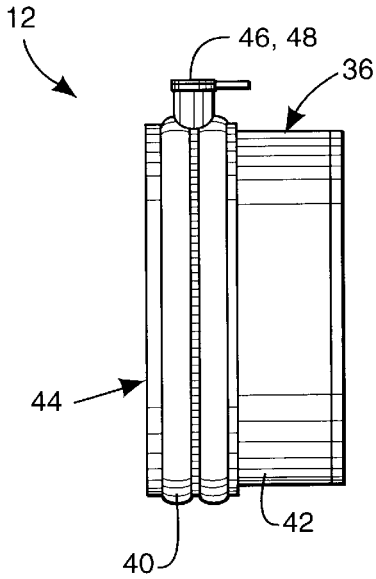
FIG. 5 is a side elevational view of another bubble forming apparatus embodying the present invention in a collapsed state.
Figure 6:
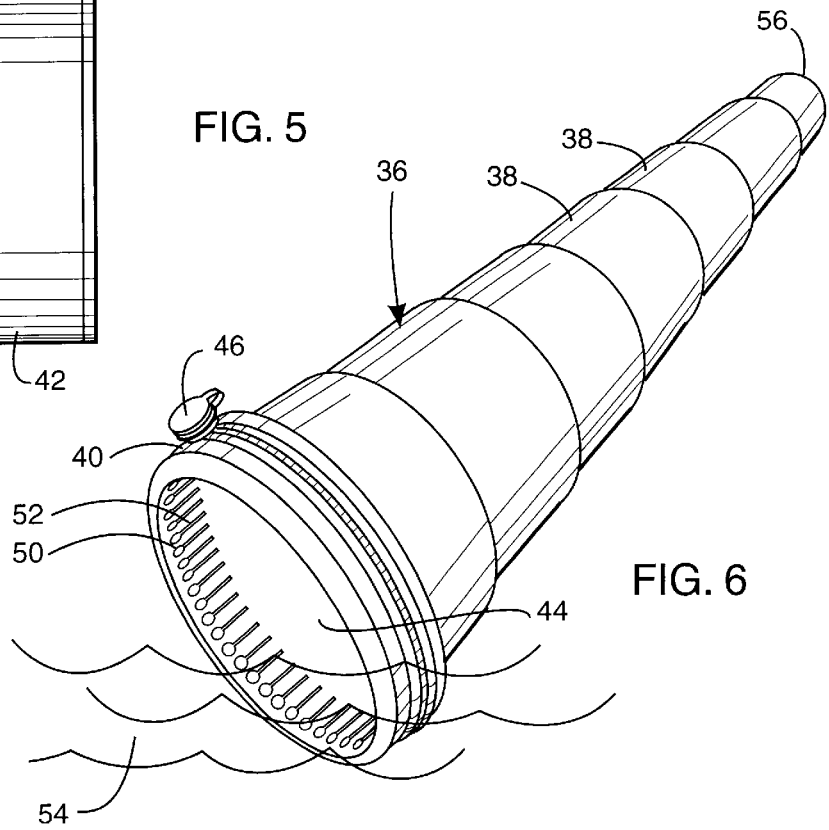
FIG. 6 is a perspective view of the bubble forming apparatus of FIG. 5 in an expanded state and being dipped into a water-based fluid.
Figure 7:
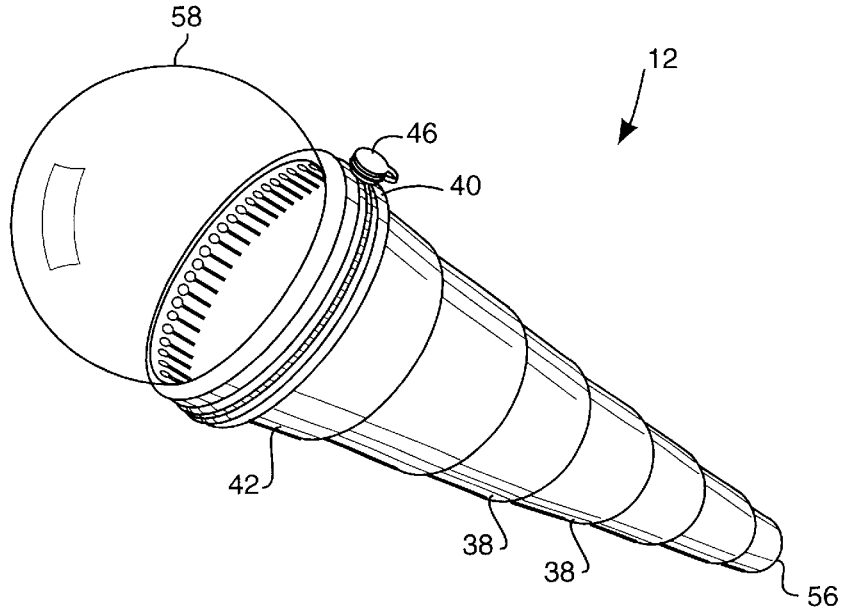
FIG. 7 is a perspective view of the bubble forming apparatus of FIGS. 5 and 6, illustrating a bubble forming at an end thereof.

As shown in the drawings for purposes of illustration, the present invention is concerned with a bubble forming apparatus generally referred to in FIGS. 1–4 by the reference number 10, and in FIGS. 5–7 by the reference number 12. The bubble forming apparatuses 10 and 12 utilize common liquid soap concentrate, such as liquid dishwashing soap, to form bubbles after dipping in a water-based fluid.

Figure 1:
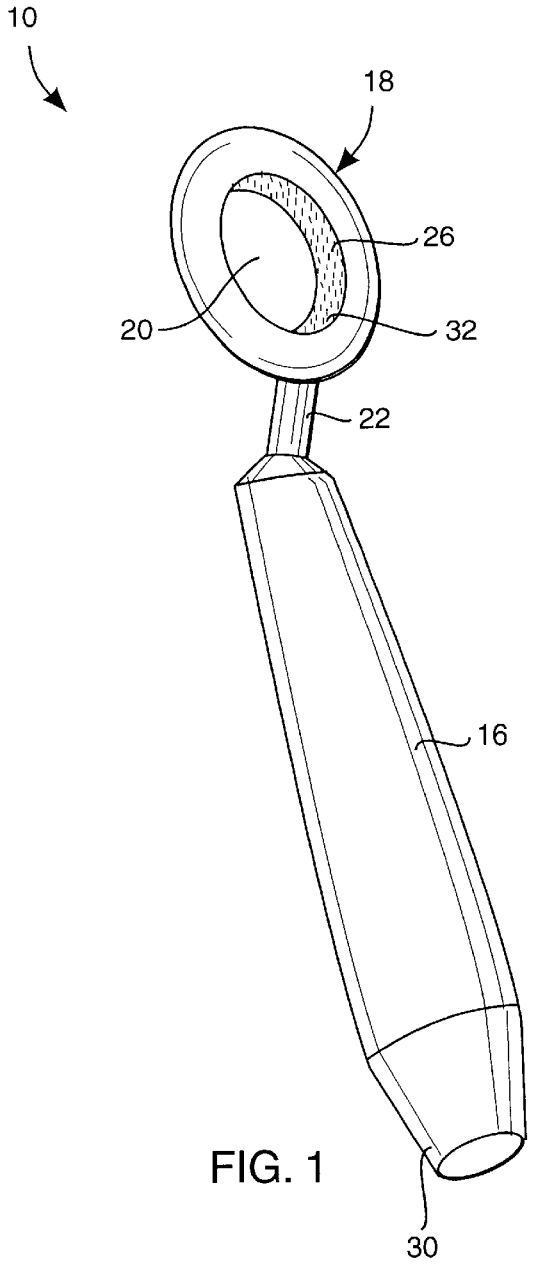
FIG. 1 is a perspective view of a bubble forming apparatus embodying the present invention.
Figure 2:
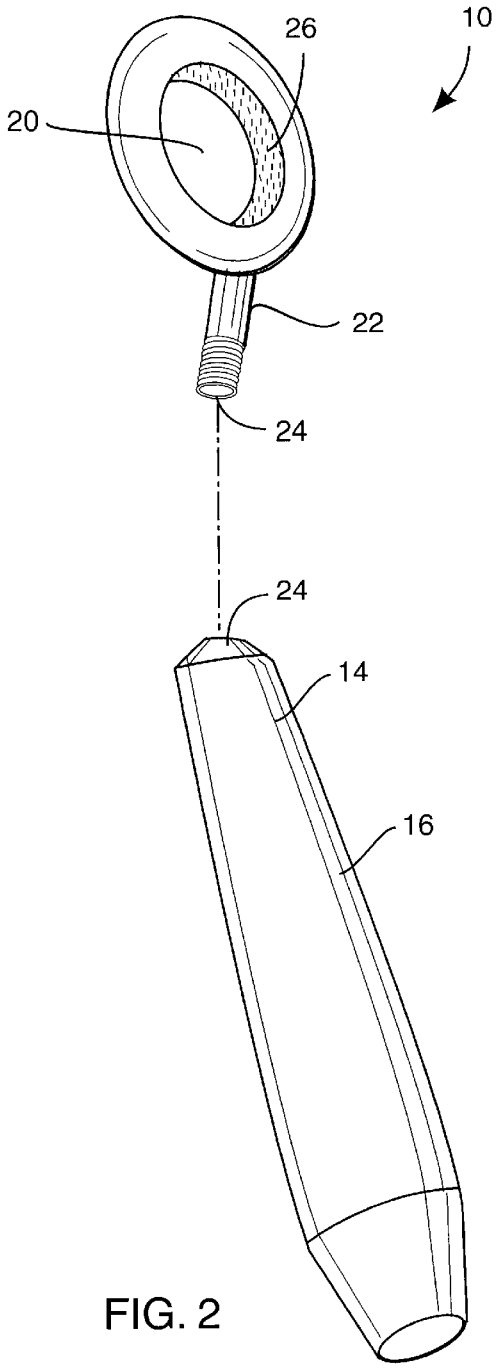
FIG. 2 is an exploded perspective view of the apparatus of FIG. 1.

Referring to FIGS. 1 and 2, the apparatus 10 is generally comprised of a liquid soap concentrate reservoir 14 contained within a handle 16. The handle 16 may comprise a disposable pre-filed liquid soap concentrate reservoir 14. The handle is preferably cylindrical in shape and flattened on a bottom surface thereof to give stability to the apparatus 10 when placed on a horizontal surface. The handle 16 may be flexible or rigid. Preferably, the handle 16 is comprised of a clear or translucent material, such as plastic, enabling one to see the liquid soap contents therein.

A bubble forming member 18 which defines a bubble forming aperture 20 is connected to the handle 16 by a tube 22. The tube 22 is hollow and forms a duct 24 to place the reservoir 14 in fluid communication with the bubble forming member 18 such that the liquid soap concentrate can flow between the reservoir 14 and the bubble forming member The bubble forming member 18 forms at least one outlet 26 which is disposed adjacent to and facing the bubble forming aperture 20. Typically, the outlet 26 comprises a continuous channel formed on an inner circumference of the bubble forming member 18, as illustrated in FIGS. 1 and 2. The liquid soap concentrate is allowed to flow to the outlet 26 by gravity, or the handle 16 may be compressed to force the liquid soap from the reservoir 14 to the outlet 26.

The reservoir 14 is refilled with liquid soap concentrate through a fill port 28. The fill port 28 may be exposed by unscrewing the tube 22 of the bubble forming member 18 from the handle 16, as illustrated in FIG. 2, or a plug 30 removable from an opposite end of the handle 16.

In use, the reservoir 14 is filled with liquid soap concentrate which flows to the outlet 26 of the bubble forming member 18. When using the pre-filled liquid soap concentrate reservoir handle 16, a cover of the pre-filled reservoir handle 16 is removed and the reservoir handle 16 is attached to the bubble forming member 18. The bubble forming member 18 is then dipped into water or a water-based fluid. The liquid soap begins to suds and a soap bubble film is created across the bubble forming aperture 20 when the bubble forming member 18 is removed from the fluid. Bubbles are produced by supplying an air stream across the soap bubble film. A one-way valve may be incorporated into the duct 24 of the tube 22 to prevent water from entering the reservoir 14 and also to prevent the soap concentrate in the reservoir from prematurely drying or running out of the apparatus 10. A liquid permeable lining 32 may also be placed between the outlet 26 and the bubble forming aperture 20 to prevent liquid soap from spilling while allowing the water-based fluid to activate the liquid soap and create a bubble film.

With reference to FIGS. 3 and 4, an open-cell wick material 34 may extend from the outlet or channel 26 and through the duct 24 and into the reservoir 14. The wick 34 preferably extends throughout the length of the reservoir 14 so that liquid soap concentrate within the reservoir 14 may be absorbed into the wick 34 and travel through the wick 34 to the outlet 26 of the bubble forming member 18. When the wick 34 is saturated with liquid soap, the bubble forming member 18 is wetted by immersion in a water-based fluid and bubbles are produced as described above. It is the nature of the wick 34 that as the liquid soap is removed therefrom at the outlet 26, additional liquid soap is absorbed into the wick so that it remains saturated or nearly saturated until the liquid soap in the reservoir 14 is depleted. The absorbing action may be facilitated by applying pressure to the flexible handle 16 to force liquid soap into the wick 34.

Referring now to FIGS. 5–7, another preferred embodiment of the present invention is illustrated. This apparatus 12 utilizes a telescoping handle 36 comprised of multiple frustroconical sections 38 of increasing diameter which are connected end to end so as to form a cone when fully extended, as illustrated in FIGS. 6 and 7. The apparatus 12 can be compressed within the largest frustronical section for easy storage and transportation, as illustrated in FIG. 5. For example, an apparatus 12 having an expanded length of eight inches can be compressed to less than two inches.

A reservoir 40 encircles the largest frustroconical section which comprises the bubble forming member 42. The bubble forming member 42 defines a bubble forming aperture 44 at one end thereof. The reservoir 40 includes a fill port 46 having a removable cap 48 for refilling the reservoir 40 with liquid soap concentrate. The reservoir 40 is in fluid with multiple outlets 50 formed in the bubble forming member 42 via ducts 52 extending between the reservoir 40 and the outlets 50. A liquid permeable lining may be disposed between the outlets 50 and the bubble forming aperture 44 to prevent unwanted discharge of the liquid soap from the outlets 50 while allowing the liquid soap to interact with exposed water-based fluid 54.

In use, as illustrated in FIGS. 6 and 7, liquid soap is added to the reservoir 40, the apparatus 12 is expanded and the bubble forming member 42 is dipped into a water-based fluid 54. The liquid soap begins to suds and upon removal from the fluid 54, a soap bubble film is produced across the bubble forming aperture 44 in a similar manner as the previous embodiment. An air stream is introduced across the bubble film by blowing into an opening 56 at the end of the apparatus 12 opposite the bubble forming aperture 44 resulting in the production of bubbles 58.

Of course, the reservoir 40 may encircle and feed liquid soap concentrate to a bubble forming member 42 of any number and types of rigid apparatuses and the above embodiments have been given as preferred embodiments and for exemplary purposes only.

The present invention offers several advantages absent from existing bubble forming device. The user is not limited by a supply of specially formulated bubble solution, but instead uses common household liquid soap. The user can create bubbles at a variety of locations such as the swimming pool, lake, ocean, or wherever there is access to water-based liquid. Conceivably, even soft-drinks, juice or a glass of water can act as a catalyst to form bubbles from the apparatuses 10 and 12.

Although several embodiments have been described in detail for purposes of illustration, various modifications may be made without departing from the scope and spirit of the invention. Accordingly, the invention is not to be limited, except as by the appended claims.

What is claimed is:

1. A method of forming bubbles for amusement, comprising the steps of:

placing a refillable reservoir of liquid soap concentrate in fluid communication with a bubble forming member encircling a bubble forming aperture and having a liquid soap concentrate outlet facing the bubble forming aperture;

delivering the liquid soap concentrate to the bubble forming member;

wetting the bubble forming member with an external water-based liquid to create a bubble film over the bubble forming aperture; and introducing an airstream across the bubble film to produce bubbles.

2. The method of claim 1, wherein the placing step includes the step of removably attaching a pre-filled liquid soap concentrate reservoir to the bubble forming member.

3. The method of claim 1, wherein the delivering step comprises the step of squeezing a flexible housing which defines the reservoir, to force the liquid soap concentrate to the bubble forming member.

4. The method of claim 1, wherein the delivering step comprises the step of allowing the liquid soap concentrate to gravitationally flow from the reservoir to the bubble forming member.

5. The method of claim 1, wherein the introducing step includes the step of either waving the apparatus or blowing across the bubble forming member aperture to produce bubbles.

6. The method of claim 1, wherein the wetting step includes the step of dipping the bubble forming member into the water-based liquid.

7. A method of forming bubbles for amusement, comprising the steps of:

placing a reservoir of liquid soap concentrate in fluid communication with a bubble forming member encircling an aperture and having an outlet channel formed on an inner circumference thereof facing the aperture;

delivering the liquid soap concentrate to the bubble forming member channel;

wetting the bubble forming member by dipping the bubble forming member into an external water-based liquid to create a bubble film over the aperture of the bubble forming member; and introducing an airstream across the bubble film by either waving the apparatus or blowing across the aperture of the bubble forming member to produce bubbles.

8. The method of claim 7, wherein the placing step includes the step of removably attaching a pre-filled liquid soap concentrate reservoir to the bubble forming member.

9. The method of claim 7, wherein the delivering step comprises the step of squeezing a flexible housing which defines the reservoir to force the liquid soap concentrate to the bubble forming member.

10. The method of claim 7, wherein the delivering step comprises the step of allowing the liquid soap concentrate to gravitationally flow from the reservoir to the bubble forming member.

11. The method of claim 7, wherein the reservoir is refillable.

* * * * *